United States Patent [19]

Giffard

[11] 4,183,806

[45] Jan. 15, 1980

[54] GRAVITATIONAL SEPARATOR EMPLOYING AN IMPROVED ELUENT SUPPLY SYSTEM

[75] Inventor: Philip J. Giffard, Southport, Australia

[73] Assignee: Mineral Deposits Limited, Australia

[21] Appl. No.: 852,456

[22] Filed: Nov. 17, 1977

[30] Foreign Application Priority Data

Nov. 22, 1976 [AU] Australia ..... PC8217

[51] Int. Cl.[2] ..... B03B 3/36

[52] U.S. Cl. ..... 209/459; 209/500; 134/109; 134/132

[58] Field of Search ..... 209/211, 434, 500, 501, 209/459; 134/109, 132, 65; 222/548

[56] References Cited

U.S. PATENT DOCUMENTS 2,431,559 11/1947 Humphreys ..... 209/211

FOREIGN PATENT DOCUMENTS 471456 8/1974 Australia .

1371241 10/1974 United Kingdom ..... 209/211

*Primary Examiner*—Frank W. Lutter

*Assistant Examiner*—Jon E. Hokanson

[57] ABSTRACT

Simple, flow regulating tap-off means are provided in the bottom of a helical eluent supply conduit which is co-axial with a helical separator sluice in a gravitational separator. The tap-off means is an insert in the floor opening of the eluent conduit having an aperture in the insert and an inner lip at the top of the insert that does not extend above the floor of the eluent conduit. A portion of the inner lip is broken away to facilitate directing the eluent to flow through the aperture. Rotating the insert varies the amount of the broken away portion in contact with the downward flowing eluent which in turn regulates the amount of eluent flow through the aperture.

8 Claims, 8 Drawing Figures

GRAVITATIONAL SEPARATOR EMPLOYING AN IMPROVED ELUENT SUPPLY SYSTEM

This invention relates to gravitational separators of the type that comprise one or more helical sluices and especially to an eluent supply system for use with such a separator.

When such a separator is in use, a mixture to be separated is suspended in an eluent, such as water, and is introduced into an inlet region at the upper part of the separator. The admitted material runs down the sluice under the influence of gravity, during which the heavier grains in the mixture settle at a faster rate and concentrate at the lower section of the sluice close to the inner edge thereof. Concentrates of the heavier grains may be withdrawn through a series of ports. Splitters located upstream of these ports may be set to suit the head feed grade. Similarly, middlings of particles intermediate in weight may be removed as a separate product through other ports in the lower turns of the sluice. Meanwhile, lighter particles in the mixture float on the heavier particles. These light particles are washed to the radially outer portion of the sluice by streams of eluent and may be discharged over the end of the lowest turn of the sluice as tailings. The eluent, which is introduced at various points along the inner edge of the sluice, also serves to elute the concentrates of the heavier grains down the helical path into the appropriate discharge ports.

It has been found that the introduction of the eluent must be effected at carefully predetermined rates which are preferably adjustable in situ.

In some previously known separators of this type, the eluent is introduced from a central manifold extending axially of the helical sluice, having a plurality of auxiliary hoses which draw streams of eluent therefrom to irrigate the sluice. The central manifold is fed at either its upper or lower end, while the other end is closed to maintain a static pressure head.

It was found that such an eluent supply system is not satisfactory in that the discharge pressure and hence the discharge rate of eluent varies drastically from hose to hose due to the change of pressure head with height. Thus, when the pressure and rate of the discharging eluent at the top portions of the sluice is optimum, that at the lower portions would be too high.

Attempts have been made to obviate this difficulty by throttling the lower eluent outlets, but this has resulted in frequent blockage of the system.

In another known type of separator, eluent is introduced to the helical sluice from a corresponding helical conduit co-axial with and of the same pitch as the separator sluice. Eluent passes from the conduit through a plurality of axially rotatable tubular quills which extend liquid-tightly through the conduit and into the eluent stream. Rotation of each quill provides accurate adjustment of eluent flow as the mouth of the quill moves into and out of register with the oncoming eluent stream.

This system of eluent supply provides accurate adjustment but is susceptible to blockage by particulate matter which cannot always be excluded from the eluent stream.

It is an object of the present invention to provide an eluent supply system which is relatively free from blockage problems and yet is capable of supplying a wide range of eluent flow rates.

According to the invention there is provided a gravitational separator of the kind comprising a helical sluice down which a stream of eluent and particulate material to be separated may flow, and eluent supply means, wherein said eluent supply means comprises a helical gallery conduit co-axial with and having the same pitch as the separator sluice, means to feed eluent to the upper end of said conduit at a rate ensuring discharge of residual eluent from the lower end of the conduit and an eluent stream in the conduit characterised by a free surface throughout its length, and a plurality of tap-off means to feed eluent from said conduit to said sluice; each tap-off means comprising an insert having an aperture therein extending through said conduit from said eluent stream, said insert having a portion of its inner lip defining the aperture entrance broken away to a greater extent than the remainer of said lip, said insert being rotatable thereby to vary the amount of eluent delivered through said aperture.

Referably, the inner lip does not protrude substantially beyond the floor of the conduit. Preferably, also, the discharge lip of each insert extends beyond the outer surface of the conduit and is provided with a relatively sharp edge so as to promote adequate flow separation and deter the eluent from clinging to the outer surface of the conduit.

A preferred embodiment of the invention will now be described, by way of example only, with reference to the accompanying drawings, in which.

Figure 2:
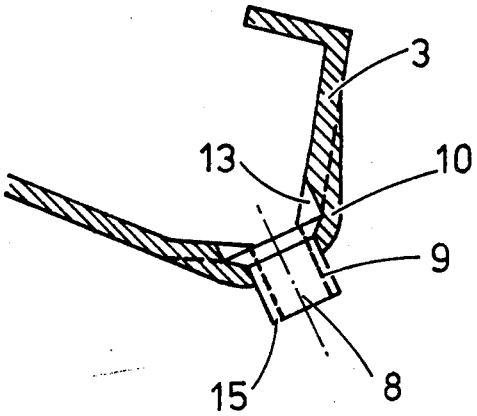
FIG. 2 is a cross-sectional view of the eluent conduit shown in FIG. 1 but in a different plane, illustrating an eluent supply aperture in the form of a sleeve insert.

Referring to the drawings, the eluent supply system comprises a helical gallery liquid conduit 3 which is coaxial with and of the same pitch as the helical separator sluice 6, both of which are supported by an axial pillar 4 such that the conduit 3 runs substantially parallel to the sluice.

Figure 7:
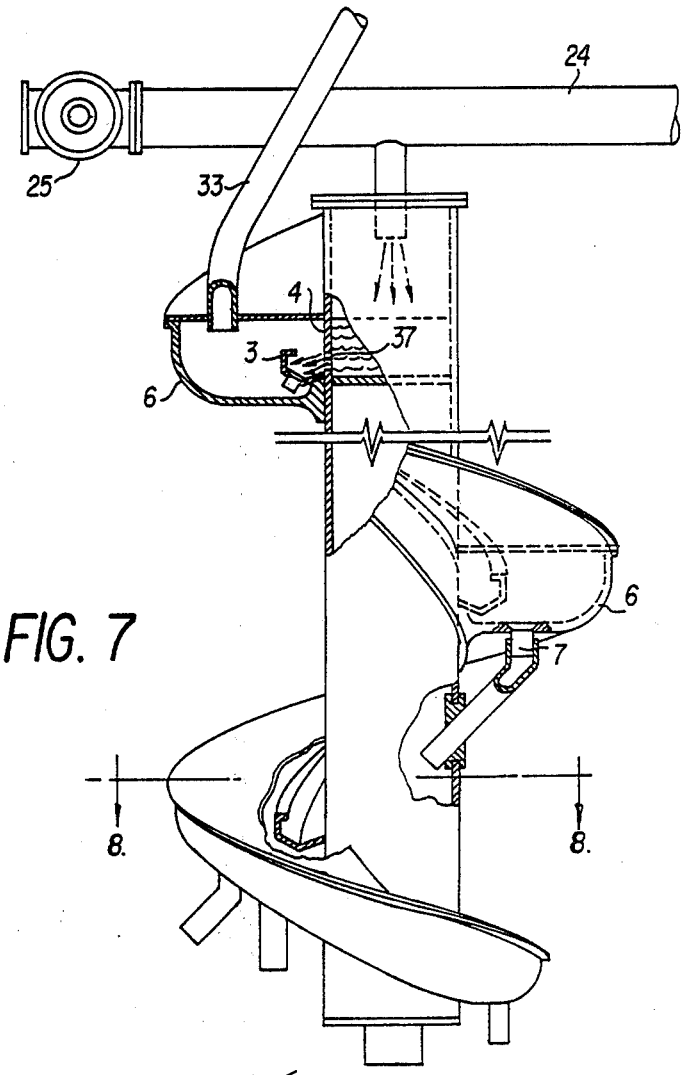
FIG. 7 is a sectional side elevation of a gravitational separator incorporating the invention.
Figure 8:
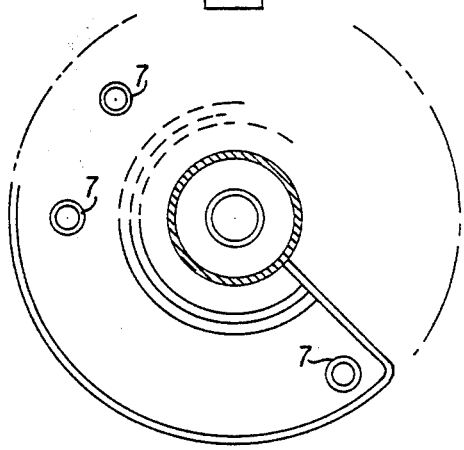
FIG. 8 is a view taken on line 8—8 of FIG. 7.

Conventional means 24 shown in FIG. 7 are provided for feeding the conduit 3 with eluent. They may comprise an elevated reservoir of the eluent communicating via a control valve 25 and a flow regulator with the upper end of the conduit 3 through a port 37. The mixture to be separated is introduced at inlet 33 and separated materials are discharged at the ports 7.

The lower end (not shown) of conduit 3 is open so that residual eluent is continuously and freely discharged therethrough. Thus, a constant flow may be maintained in conduit 3.

Streams of eluent are tapped-off at various points along the conduit 3 through tap-off means so as to elute the mixture passing down the sluice and wash the lighter particles towards the outside of the sluice. The heavier particles are progressively drawn off by appropriate splitters (not shown) fitted to drainage ports 7.

Figure 3:
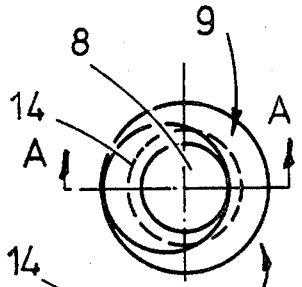
FIG. 3 is an enlarged plan view of the sleeve shown in FIG. 2.
Figure 4:
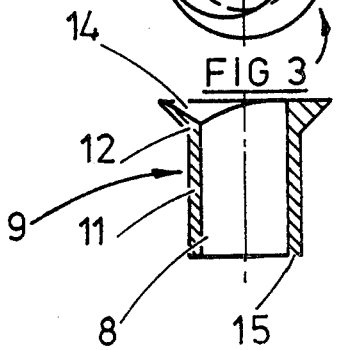
FIG. 4 is a sectional view taken on line A—A of FIG. 3.
Figure 1:
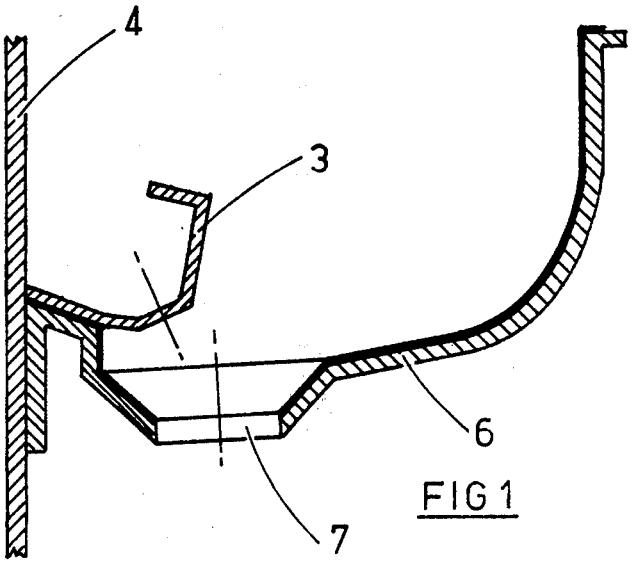
FIG. 1 is a cross-sectional view of a sluice of a helical gravitational separator furnished with an eluent supply system according to the invention.

Each tap-off means comprises an aperture defined by a bore 8 through a sleeve insert 9 extending through the conduit 3 and projecting a short distance beyond its outer wall 10. As best shown in FIGS. 3 and 4, the sleeve comprises a right-cylindrical shank portion 11 extending downwardly from a head portion 12 which projects outwardly so as to locate the sleeve in an appropriately countersunk bore 13 in the conduit 3. If required, additional locating means 22 may be provided in the form of an O-ring or circlip to prevent accidental removal of the sleeve.

The inner lip of the insert defining the aperture entrance of bore 8 is broken away over a portion of its periphery 14 by means of an eccentric countersink. Preferably, the entire lip exhibits some chamfering to lessen the accumulation of foreign matter but the leading portion 14 is more heavily broken.

Figure 5:
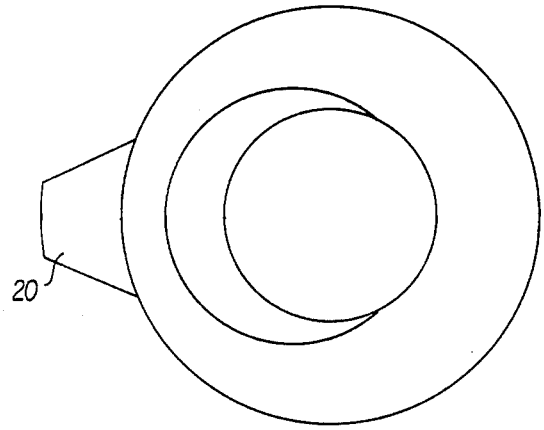
FIG. 5 is a plan view of a sleeve insert.
Figure 6:
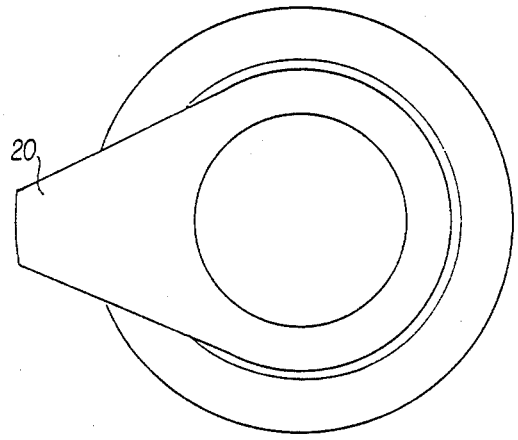
FIG. 6 is an inverted plan of the insert shown in FIG. 5.

When the sleeve 9 is placed in the eluent stream with the portion 14 facing the flow, the rate of eluent delivery through the bore 8 will be a maximum for a given flow condition through the conduit. If the sleeve is rotated slightly, preferably by a short handle 20 retained on the projecting part of the sleeve as shown in FIGS. 5–6, the flow rate through the bore 8 will decrease as the portion 14 moves away from a position of direct confrontation with the flow; the delivery rate reaching a minimum when the portion 14 extends downstream of the flow. In this way, an acceptable range of flow rate adjustment is possible.

The discharge lip 15 of the insert projects beyond the conduit and is furnished with a sharp edge as shown so as to promote flow separation and prevent the eluent from adhering to the underside of the conduit. If desired, the outer surface of the sleeve adjacent the lip 15 may be cut away to define a knife-edge lip to ensure maximum separation.

Although the invention has been described with reference to specific examples, it will be appreciated by those skilled in the art that the invention may be embodied in many other forms without departing from the scope of the inventive concept.

The claims defining the invention are as follows:

I claim:

1. In a gravitational separator having a helical separator sluice down which a stream of eluent and particulate material to be separated flows, and a co-axial eluent supply means having a helical gallery conduit with the same pitch as the separator sluice, means to feed eluent to the upper end of said conduit at a rate ensuring discharge of residual eluent from the lower end of the conduit, said conduit having a free floor surface throughout its length over which the eluent stream flows, and a plurality of tap-off means to feed eluent from said conduit to said separator sluice; the improvement wherein each tap-off means comprises an insert extending through said conduit, said insert having an aperture therein communicating with said eluent stream and an inner lip defining an eluent stream entrance to said aperture, said inner lip being positioned in the floor of said conduit so as not to protrude substantially therebeyond into said eluent stream, a portion of the inner periphery of said inner lip being broken away to a greater extent than the remaining inner periphery of said inner lip, said insert being rotatable thereby to vary the amount of eluent delivered through said aperture.

2. A gravitational separator as defined in claim 1 wherein said inner lip is broken away by an eccentric countersink.

3. A gravitational separator as defined in claim 1 wherein said inner lip is chamfered in its entirety to deter the accumulation of foreign material.

4. A gravitational separator as defined in claim 1 wherein said insert extends downwardly beyond the outer surface of said conduit and said aperture forms a discharge lip.

5. A gravitational separator as defined in claim 4 wherein said discharge lip is provided with a relatively sharp edge to promote flow separation and deter said eluent from clinging to the outer surface of said conduit.

6. A gravitational separator as defined in claim 4 wherein the projecting portion of said insert is provided with handle means to facilitate rotation.

7. A gravitational separator as defined in claim 1 wherein said insert comprises a right cylindrical shank portion extending downwardly from a head portion which projects outwardly so as to locate said insert in a corresponding bore in said conduit.

8. A gravitational separator as defined in claim 7 wherein said shank portion is provided with means to retain said insert within said bore.

* * * * *